United States Patent [19]

Caillier

[11] Patent Number: 4,856,590

[45] Date of Patent: Aug. 15, 1989

[54] PROCESS FOR WASHING THROUGH FILTER MEDIA IN A PRODUCTION ZONE WITH A PRE-PACKED SCREEN AND COIL TUBING

[76] Inventor: Mike Caillier, 261 Rees St., Breaux Bridge, La. 70517

[21] Appl. No.: 935,742

[22] Filed: Nov. 28, 1986

[51] Int. Cl.[4] ..... E21B 19/22; E21B 43/04; E21B 43/08

[52] U.S. Cl. ..... 166/278; 166/51; 166/312; 166/384

[58] Field of Search ..... 166/278, 276, 77, 384, 166/51, 157, 228

[56] References Cited

U.S. PATENT DOCUMENTS

| | | | |
|---|---|---|---|
| 2,207,334 | 7/1940 | Reynolds et al. | 166/278 |
| 2,652,117 | 9/1953 | Arendt et al. | 166/278 |
| 2,775,303 | 12/1956 | Abendroth et al. | 166/278 |
| 2,905,245 | 9/1959 | DePriester | 166/278 X |
| 3,075,581 | 1/1963 | Kern | 166/278 X |
| 3,353,599 | 11/1967 | Swift | 166/278 |
| 3,378,076 | 4/1968 | Metler | 166/278 X |
| 3,548,935 | 12/1970 | Harkins | 166/228 X |
| 3,658,270 | 4/1972 | Slator et al. | 242/54 |
| 3,791,447 | 2/1974 | Smith et al. | 166/384 X |
| 3,891,565 | 6/1975 | Colpoys | 166/278 |
| 3,913,675 | 3/1975 | Smyrl | 166/278 |
| 4,018,284 | 4/1977 | Perkins | 166/278 |
| 4,681,163 | 7/1987 | Guidry et al. | 166/278 |

OTHER PUBLICATIONS

Baker Sand Control, '80–'81 Catalog, p. 16.

"Carborundum Sintered Bauxite for Sand Control Applications: Product Specifications", 9/83, 2 pages.

*Primary Examiner*—Stephen J. Novosad

*Attorney, Agent, or Firm*—Pravel, Gambrell, Hewitt, Kimball & Krieger

[57] ABSTRACT

A process including the initial step of lowering a length of coil tubing down through the internal production bore, so that the end of the tubing which is at the depth of the preforations in the external casing, and a volume of fluid such as water is washed into the hole so that sand contained within the hole is washed out of the hole up through the annulus between the internal casing and the coil tubing. The coil tubing is then removed from the hole, and a second length of coil tubing is lowered into the hole with a blunt bottom gauge ring sub to approximately the same depth, and a quantity of ceramic beads are "squeezed" into the well bore so that the beads enter through the perforated tunnels and fill a zone exterior to the tunnels in the sand formation around the perforations. The well is then shut down and after the beads have been placed to a calculated depth, a bottom hole assembly is lowered into the hole at the end of the coil tubing, the assembly comprising a lowermost cone portion for emitting fluids into the beads for washing down the beads, and an upper portion having a filter means on its wall, so that production from the hole through the beads may be filtered into the bottom hole assembly and returned up the bore to the surface. However, prior to the production being allowed to go forth, the bottom hole assembly is hydraulically released from the coil tubing, and the coil tubing is retrieved from the hole with the bottom hole assembly serving as a means to filter the beads and to begin receiving hydrocarbons that have filtered through the beads. Because of the absolute spherical nature of the beads, an absolute flow space is created between the beads, and therefore while the hydrocarbons may filter therethrough, the sand is caught within the beads at a point exterior the casing, and the beads serve to filter out any sand which may attempt to flow therethrough.

5 Claims, 4 Drawing Sheets

PROCESS FOR WASHING THROUGH FILTER MEDIA IN A PRODUCTION ZONE WITH A PRE-PACKED SCREEN AND COIL TUBING

BACKGROUND OF THE INVENTION

1. Field of the Invention

The process of the present invention relates to workover of a production hole to increase hydrocarbon production. More particularly, the process of the present invention relates to washing out formation sand within a production hole through the use of coil tubing, pressurizing a calculated quantity of spherical beads into the production zone and washing through the ceramic beads with a pre-packed system (screen) so that production is maintained through the media while holding back any sand within the formation.

2. General Background

In the overall process for drilling and production of hydrocarbons within the earth, at that point in the process where a hydrocarbon formation has been located at a particular depth, normally an exterior casing is lowered down the hole through the production zone, and an internal production tubing is lowered into the exterior casing. The annulus between the interior tubing and the exterior casing is packed off so that any of the hydrocarbons coming from the formation are recovered through the internal production tubing. Likewise, the exterior casing is packed off below the production zone so that the oil produced, of course, may go up to the surface. Following the packing off of the casing, the wall of the exterior casing is perforated through the use of a perforating gun or the like, so that the hydrocarbons may travel through the perforations in the wall of the casing and, under pressure, go to the surface for collection.

One of the problems which is confronted in this particular process is that as the formation is releasing hydrocarbons, a portion of the sand surrounding the exterior casing may collapse and the sand itself may be drawn into the well and collected on the surface. This, of course, is not beneficial, and must be dealt with so that the hydrocarbons are not contaminated with formation sand.

In the present state of the art, what is required is an extremely expensive undertaking which requires that a workover rig be set in place, and that the formation be "gravel packed", so that the formation is theoretically kept away from the casing, yet the hydrocarbons are allowed to seep through and be collected free of sand. However, the problem with gravel packing in this particular instance is that gravel, due to its irregular shape, may oftentimes cause a "bridging effect" within the casing, so that any washover tool or the like which is set within the gravel pack may become stuck within the hole, and the entire workover tool has to be retrieved in order to solve the problem. In addition, the "bridge" formed by the gravel pack may create voids beneath the bridge resulting in formation sand having direct contact with the hydrocarbons in the production tubing. In addition, oftentimes a workover rig, in order to clear production sand within the casing, runs to an expense of approximately $750,000 per job.

In addition, the use of gravel pack sand, in order to undertake a workover process due to its irregular shape will create fines in (a) transportation, (b) pumping through triplex pumps and (c) during the squeeze mode when the gravel is squeezed through the perforations.

These fines could conceivably enter the screen and stick the internal wash pipe, which of course would have to be removed during the process under a great expense.

In the present state of the art, the three alternatives which the present invention could ultimately replace are (a) sand consolidation; (b) resin coated sand and (c) through tubing gravel packing. These three processes have met with limited success but cannot compare to the overall efficiency, low cost, and success of the present invention.

Therefore, there is a need in the industry for a process whereby the expense can be drastically cut in washing through a formation so that hydrocarbons may continue to be recovered from the ground without sand being mixed with hydrocarbons.

SUMMARY OF THE PRESENT INVENTION

The process of the present invention solves the shortcomings in the present state of the art at significantly reduced costs. What is provided is that in the instance when a production formation has become contaminated with formation sand in the production zone, the process would include the initial step of lowering a length of coil tubing down through the internal production bore, so that the end of the tubing is at the depth of the perforations in the external casing, and a volume of fluid, such as water, is washed into the hole so that sand contained within the hole is washed out of the hole up through the annulus between the internal tubing and the coil tubing. The coil tubing is then removed from the hole, and a second length of coil tubing is lowered into the hole with a blunt bottom gauge ring sub to approximately the same depth, and a quantity of absolute diameter ceramic beads are "squeezed" into the well bore so that the beads are entered through the perofrated tunnels and fill a zone exterior to the tunnels in the sand formation around the perforations. The well is then shut down, and after the beads have been placed to a calculated depth, a bottom hole assembly is lowered into the hole at the end of the coil tubing. The assembly comprises a lowermost cone portion for emitting fluids into the beads for washing out through the beads, as the assembly is lowered thereinto, and an upper portion having a prepacked filter screen on its wall, so that production from the hole through the beads may be filtered into the bottom hole assembly and returned up the production string to the surface. However, prior to the production being allowed to go forth, the bottom hole assembly is hydraulically or mechanically released from the coil tubing, and the coil tubing is retrieved from the hole with the prepacked screen serving as a means to filter the beads and to begin receiving hydrocarbons that have filtered through the beads. Because of the absolute spherical nature of the beads, an absolute flow space is created between the beads, and therefore while the hydrocarbons may filter therethrough, the sand is caught within the beads at a point exterior the casing, and the beads serve to filter out any sand which may attempt to flow therethrough.

Therefore, it is the principal object of the present invention to provide a process whereby a washdown of the bottom hole assembly may be undertaken at a great saving under the current methods, and under a reduced amount of time;

It is still a principal object of the present invention to provide a process of washing through filter media in a production zone, utilizing a media which has a constant and absolute spherical diameter to serve as a means for assuring that hydrocarbons are filtered therethrough but the formation sand is held back;

It is still a further object of the present invention to provide a process utilizing coil tubing and spherical beads for washing through a production zone, without the use of a workover rig; and It is still a further object of the present invention to provide a process for washing through a production zone whereby the sand within the formation is held back through a filter media, and a prepacked screen retains the media in the production zone, yet allows the hydrocarbons to flow therethrough to the surface.

DETAILED DESCRIPTION OF THE PREFERRED EMBODIMENT

Figure 1:
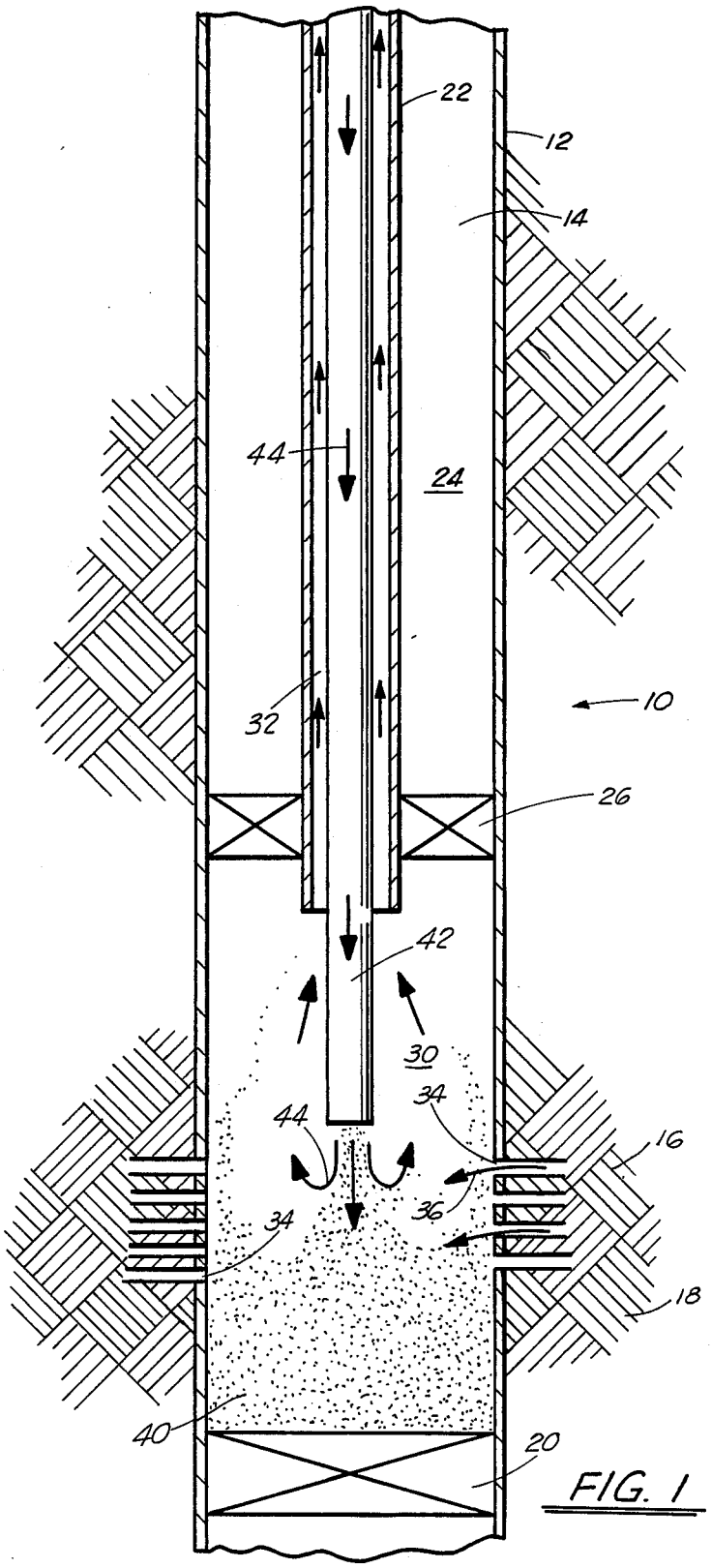
FIG. 1 is an overall cross-sectional view of a step in the process of the present invention.

FIGS. 1–4 illustrate the preferred embodiment of the present invention. FIG. 1 illustrates a downhole production line 10 which would include an exterior production casing 12 which comprises a series of annular pipes having a bore 14 therethrough to provide a continuous walled bore between the rig floor and the production zone 16 which, for purposes of illustration, will contain hydrocarbons within the surrounding media 18 which is a rock or sand formation. In the process following the location of the production zone, the casing 12 has been lowered into the hole and has been sealed off with a packing seal 20 at the lowermost portion of the casing. Following that step an internal production tubing 22 is lowered into the exterior casing 12 to a depth substantially above the formation zone and the annular space 24 between the inner wall of the external production casing 12 and internal production tubing 22 is packed off again with a packing member 26 so that anything which would come up through production zone 30 within the annulus 24 of the exterior casing 12 would be forced up through the interior annulus 32 of internal production tubing 22.

There is further shown in the Figures a series of perforations 34 which have been formed in the wall of exterior production casing 12, through the use of a perforation gun or the like, so that hydrocarbons contained within formation 18 flow through bores 34 in the direction of Arrows 36 and up the annulus 32 of internal tubing 22 for recovery on the surface.

The present process solves a problem which has confronted the art in this particular stage of production. What often happens is that in the surrounding media 18 in the production zone 16, sand or the like will collapse and will begin entering the perforations 34, and mixed with the hydrocarbons in the zone, will be forced up the annulus 32 so that the oil recovered in the floor is contaminated with formation sands, which constitute a very fine powder-like sand which is, of course, undesirable in collection.

Therefore, the process of the present invention will be utilized to overcome this problem. What would be included is following the sand formation (accumulating and blocking off the flow of oil), which is represented by the series of dots 40 in the collection zone 30, a section of coil tubing 42 is lowered into the hole from the rig. Coil tubing, in the art, is a continuous strand of metal tubing which is maintained on large spools on the rig floor and is lowered down into the annulus through annular space 32 to a position substantially equal to the position of the perforations 34 in collection zone 30. Following the lowering of the coil tubing 42, fluid is then pumped through a bore in the tubing 42 in the direction of Arrows 44 and the fluid (such as water or the like) would wash out the sand 40 from the zone 30 with the sand 40 traveling up the annulus 32 within internal tubing 22. Following that process where the formation sand 40 has been washed out of zone 30, reference is now made to FIG. 2.

Figure 2:
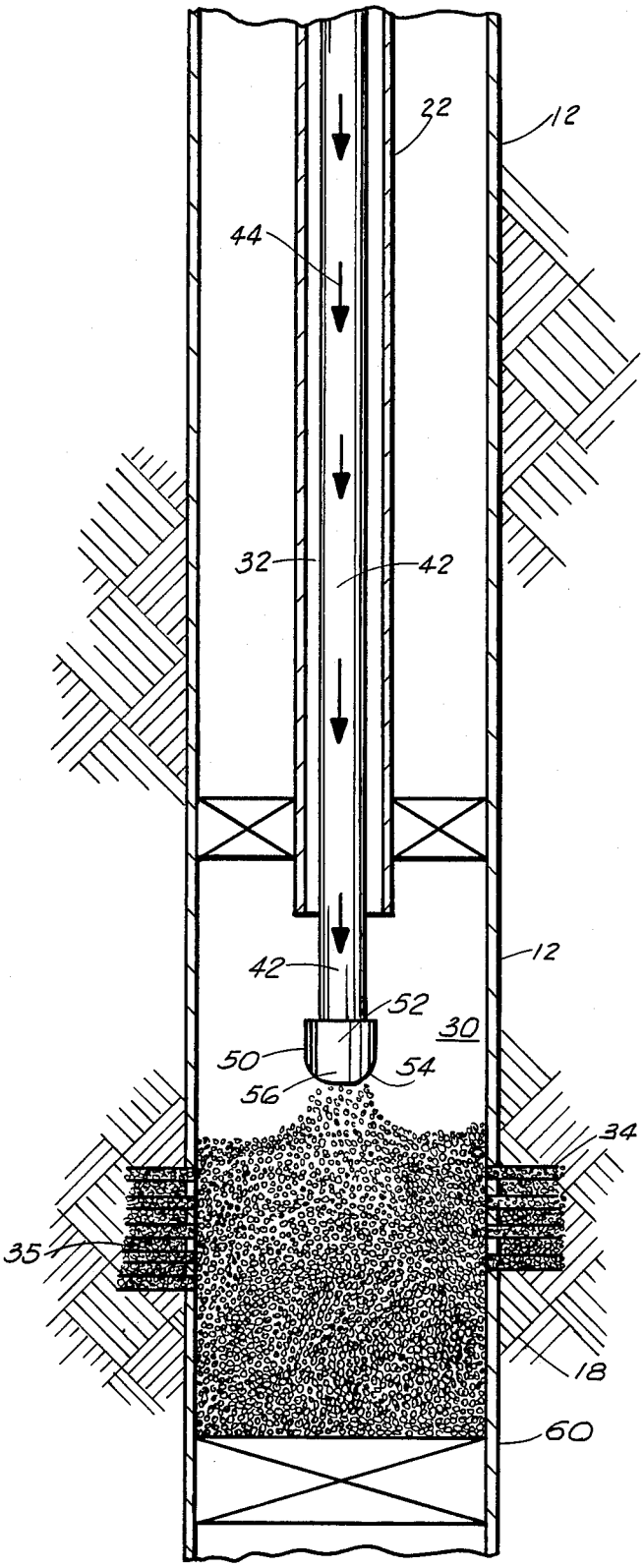
FIG. 2 is an overall cross-sectional view of a further step in the process of the present invention.

In FIG. 2 there is also illustrated as in FIG. 1 a length of coil tubing 42 lowered into the hole to a position substantially at the top of the production zone 30. In this instance the coil tubing has attached to its lowermost end a blunt bottom gauge ring sub 50 which for the most part has a threadable top portion 52 threadably attached to the lowermost end of the coil tubing 42, and a curved bottom portion 54 which serves as a semi-blunt end, the function of which will be described further, with the ring sub having a continuous bore 56 therethrough which is coaxial with the bore 83 (see FIG. 3) in coil tubing 42.

Following the positioning of the coil tubing as seen in FIG. 2, the process would entail sending down a measured quantity of spherical members such as ceramic beads 60 or like substance, which comprise an absolute spherical shape and are able to withstand heat and pressure downhole. The ceramic beads 60 ideally have a diameter 5 to 6 times greater than the size of the 50 percentile diameter of the formation sand, the function of which will be described further. The beads 60 are lowered down into the production zone 30, and are "squeezed" through the perforations 34 within outer casing 12 to fill the zone 35 directly adjacent the exterior of the wall casing 12 in the formation 18 with a quantity of beads 60. Thus, literally, the beads 60 have forced any formation sand 40 that may have been in the zone adjacent the perforations 34 to retract back into the formation so that any hydrocarbons or sand now flowing into the perforations 34 would have to filter through the ceramic beads 60.

In order to ascertain exactly the depth of the ceramic beads within the zone 30, gauge ring sub 50, with the semi-blunt end 54, is then lowered until contact is made with the upper surface of the beads 60 within zone 30 and recorded on the surface. Therefore, there is determined the exact quantity of beads 60 that have been placed into the hole and their specific depth within zone 30. Following the beads 60 having reached their desired depth, the coil tubing 42 with ring sub 50 is retrieved out of the hole and the rig is shut down.

Figure 3:
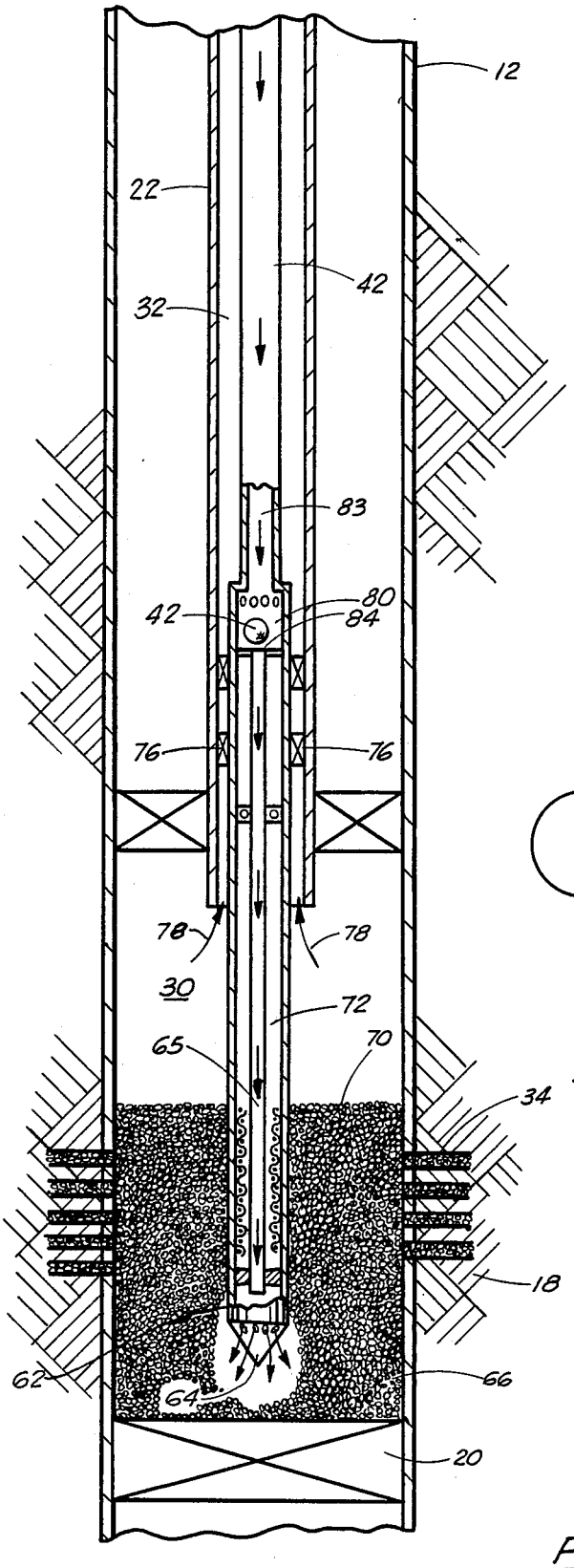
FIG. 3 is a further step in the process of the present invention.
Figure 5:
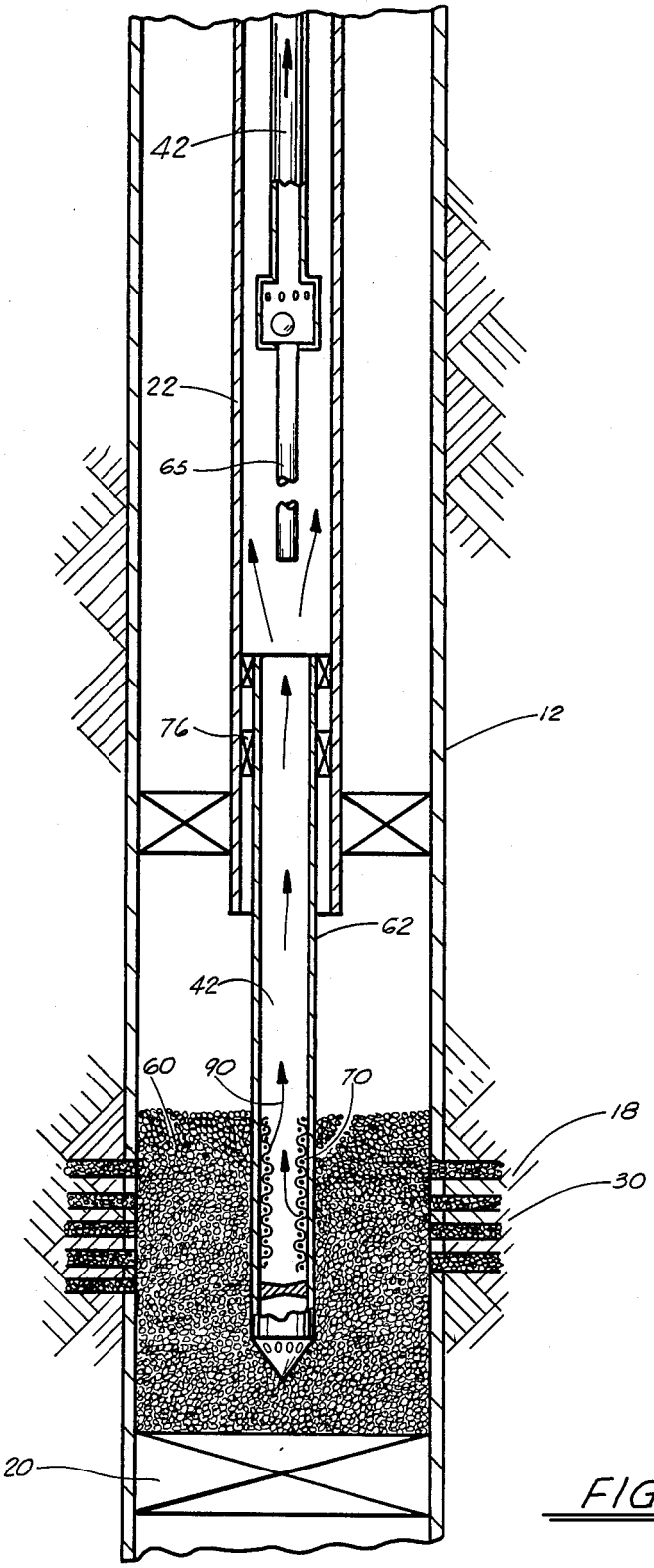
FIG. 5 represents a view of a recompletion production zone.

Reference is now made to FIG. 3, where the coil tubing 42 is once more lowered into the hole with a jet shoe 62 mounted on the very end of the coil tubing, the jet shoe 62 serving as a means for washing through the ceramic beads 60 within the exterior casing 12 while the jet shoe is lowered to the bottom of the production zone 30. As seen in FIGS. 3 and 5, jet shoe 62 is provided with a lowermost cone end 64 which serves as the means for washing through the layer of ceramic beads 60 so that the shoe 62 may reach a depth substantially equal to the depth of plug 20. Following the positioning of jet shoe 62 at that depth, a pre-packed screen 70, which is a standard pre-packed screen comprising an outer screen, an inner screen, and a layer of filter media (such as gravel or beads) therebetween, and which serves as a means for holding back the ceramic beads as the hydrocarbons filter therethrough is in position adjacent beads 60.

Therefore, what is desired at this point is that any hydrocarbons which are retrieved from the formation 18 through perforations 34 can be retrieved through the bead media 60 and through screen 70 into the bore of production tubing 22 to the surface. In order to assure this flow, there is provided a series of plugs 76 within the lower portion of annulus 32, so that any oil which may filter up through the zone 30 into annulus 32 as seen by Arrows 78 will be blocked by plugs 76 and will not go any further in annulus 32. Following the flowing of fluid through internal wash pipe 65 within jet shoe 62, and the positioning of plugs 76 within annulus 32, a hydraulic or mechanical release mechanism 80 is activated at the connection between jet shoe 62 and coil tubing 42. this is activated by the use of a release means such as a bearing 82 dropped within the bore 83 of coil tubing 42. The bearing 82 would be seated at seat 84 which is the top portion of internal wash pipe 65, and flow would be discontinued. The pressure built up to that point would create a hydraulic or mechanical release to be activated thus releasing the coil tubing 42 from the jet shoe 62 so that the coil tubing 42 may be retrieved after the jet shoe 62, with screen unit 70, is set in place as seen in FIG. 3, so that oil may then flow up internal bore 72 and into the bore 32 of production string 22 and be collected on the surface.

Figure 4:
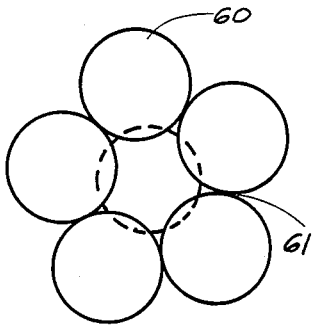
FIG. 4 is a representational view of the spherical beads utilized in the process of the present invention.

It should be noted that FIG. 4 represents a closed formation of beads 60 as they may appear hypothetically within the production zone 30. It should be noted that for purposes as was described earlier, the beads are substantially 5 to 6 times greater in diameter than 50% of the sand within the formation, which can be tested easily under the present state of the art for size. Therefore the space 61 between beads 60 would be of such a small absolute size that hydrocarbons may flow therethrough but sand even 5 to 6 times smaller than the beads 60 would be blocked and therefore the beads 60 would serve as a means for maintaining the sand within the formation.

FIG. 5 represents the completed process of the present invention. As shown in the Figure, spherical beads 60 are situated in the production zone 30 around the assembly which is maintained within the external casing 12 which houses the pre-packed screen 70. There is represented the fact that coil tubing 42 has been mechanically or hydraulically released from jet shoe 62 and screen 70, and is being retreived back up the bore 32 of internal production tubing 22. At this point, hydrocarbons as indicated by Arrows 90 within the internal lower zone of pre-packed filter 70 are allowed to flow up the bore 92 of the assembly and into the production tubing 22 to the surface. It should be noted that due to the pack-off as indicated earlier, the only flow space available for the hydrocarbons is through the pre-packed filter 70 and up through the production tubing 22.

This is a very important aspect of the present process in view of the fact that when other processes attempt to utilize gravel as was discussed further, because of the irregular shape of gravel and the breaking of the sand within the gravel, the gravel may tend to form a bridge effect and the flow is blocked completely. In this case, the spherical beads serve as a constant filter means yet assure that there will be a flow space for the hydrocarbons within the zone. Therefore, using this type of a process, without having to utilize a workover rig is an absolute means for assuring that for a very inexpensive cost (in most cases 1/10 of the cost of the workover rig, following a washover this process may take place with 75% to 80% production in line.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. In a production zone, in which there is located an exterior production casing, having a plurality of perforations defining a production flow space from the zone into the interior of the casing, and an interior production tubing for allowing the production flow into the production casing to flow up through the production tubing to the surface, wherein formation sand has become mixed with the hydrocarbons produced, a process for washing through and setting a pre-packed system across the production zone, to prevent further intrusion of formation sand into the external production casing, the process comprising the following steps:

a. washing to the surface formation sand situated within the production casing at the level of the production zone;

b. inserting coil tubing down the production tubing within the production casing to the depth of the production zone;

c. lowering down through the coil tubing into the collection zone a mass of spherical media, having an absolute diameter of not less than 5 times greater the than diameter of 50% of the formation sand in the production zone;

d. filling the space within the production zone and any perforations within the wall of the production casing with spherical media; and e. placing a pre-packed filter between the media and the production tubing for allowing hydrocarbons to flow through the media to the production tubing, yet preventing any of the spherical media from flowing into the production tubing.

2. The process of claim 1, wherein prior to hydrocarbons flowing up the production tubing, the coil tubing is removed from the production tubing.

3. The process in claim 2, wherein the step of removing the coil tubing further comprises triggering a hydraulic or mechanical release mechanism from the surface.

4. The process in claim 1, wherein the media further comprises a mass of spherical ceramic beads which serve to filter out any formation sand flowing into the production casing.

5. The process in claim 1, wherein the pre-packed filter further comprises first and second filter screens having a media therebetween, the media generally comprising ceramic beads or gravel.

* * * * *